United States Patent [19]

Connolly

[11] Patent Number: 4,584,930

[45] Date of Patent: Apr. 29, 1986

[54] VENTILATION SYSTEMS FOR GLOVE BOXES

[75] Inventor: Paul A. Connolly, Seascale, England

[73] Assignee: British Nuclear Fuels Limited, Warrington, England

[21] Appl. No.: 477,910

[22] Filed: Mar. 23, 1983

[30] Foreign Application Priority Data

Apr. 6, 1982 [GB] United Kingdom ..... 8210123

[51] Int. Cl.[4] ..... F23J 11/00

[52] U.S. Cl. ..... 98/115.3; 55/287; 252/630

[58] Field of Search ..... 98/33 R, 43 R, 43 A, 98/43 B, 115 R, 115 LH, 1.5; 55/287, 288, 385, DIG. 9; 252/630, 633

[56] References Cited

U.S. PATENT DOCUMENTS

| | | | |
|---|---|---|---|
| 3,093,564 | 6/1963 | Weisman et al. | 252/630 X |
| 3,501,923 | 3/1970 | Lehmer | 252/630 X |
| 4,227,900 | 10/1980 | Nichols et al. | 55/287 X |
| 4,435,194 | 3/1984 | Picard et al. | 98/115 LH X |

FOREIGN PATENT DOCUMENTS

| | | | |
|---|---|---|---|
| 2608162 | 9/1977 | Fed. Rep. of Germany | 252/630 |
| 1462995 | 11/1966 | France | 55/288 |
| 2473150 | 7/1981 | France . | |
| 36295 | 3/1977 | Japan | 252/630 |
| 36297 | 3/1977 | Japan | 252/630 |
| 405565 | 3/1974 | U.S.S.R. | 55/287 |

OTHER PUBLICATIONS

J. Grant et al., "Vortex Control of Safety Enclosures", *Nuclear Energy,* vol. 20, No. 4, London, G.B., Aug. 1981, pp. 303–309.

Weichselgartner, H., "A New Process to Remove Tritium from Glove Box Atmospheres", *Conference: Ninth Symposium on Engineering Problems of Fusion Research,* Chicago, IL, Oct. 1981, pp. 26–29.

*Primary Examiner*—Harold Joyce

*Attorney, Agent, or Firm*—Larson and Taylor

[57] ABSTRACT

A ventilation system for a glove box (1) comprising first (4,5) and second (10,14) extract flow lines connected in parallel between a common outlet (15) from the box and a suction pump (6). Each extract line includes a vortex amplifier (3,9) and a filter (11,12). The vortex amplifiers are chosen such that under normal operating conditions the required depression within the box is maintained by flow along the first of the extract lines and a reverse flow from the vortex amplifier in the second extract line passes through the filter in that line and exits through the first extract line without passing into the glove box. The second extract line functions as an emergency extract capability in the event of a breach of the glove box and the reverse flow keeps the filter in the line in a clean and usable condition.

2 Claims, 3 Drawing Figures

VENTILATION SYSTEMS FOR GLOVE BOXES

The present invention concerns a ventilation system for glove boxes and the like facilities.

BACKGROUND OF THE INVENTION

It is recommended that glove boxes and the like facilities which receive radioactive or toxic materials are provided with ventilation systems which can provide an emergency extract capability in the event of a breach of the containment, for example in the case of the loss or rupture of a glove. It is known to employ vortex amplifiers for this purpose and in situations which involve dry and dusty conditions within the glove box to utilize two extract flow lines, namely a normal and an emergency extract, between the box and an extract source, usually asuction pump. Each line can include a vortex amplifier and a filter. Alternatively, the normal extract line can be a direct connection containing a valve with the emergency extract line having a vortex amplifier. Under normal operational conditions the vortex amplifier in the emergency extract operates in a reverse purge mode to prevent blockage of its associated filter and thereby maintain the emergency extract capability. This reverse flow into the glove box which is obtained from atmospheric air admitted at the control port or ports of the vortex amplifier can result in difficulties when it is required to maintain an inert gas atmosphere within the glove box.

FEATURES AND ASPECTS OF THE INVENTION

To avoid this problem and according to the present invention there is provided a ventilation system for a glove box or the like containment in which a normal extract line and an emergency extract each communicate with the box or containment through a common flow line.

DESCRIPTION OF THE DRAWINGS

The invention will be described, by way of example, with reference to the accompanying drawings; in which.

DESCRIPTION OF THE PREFERRED EMBODIMENTS

Figure 1:
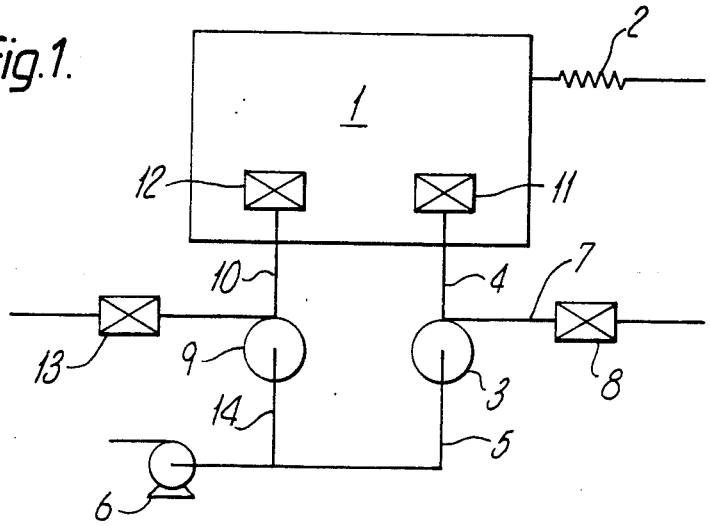
FIG. 1 is a diagram of an existing ventilation system for a glove box and not forming a part of the present invention.
Figure 2:
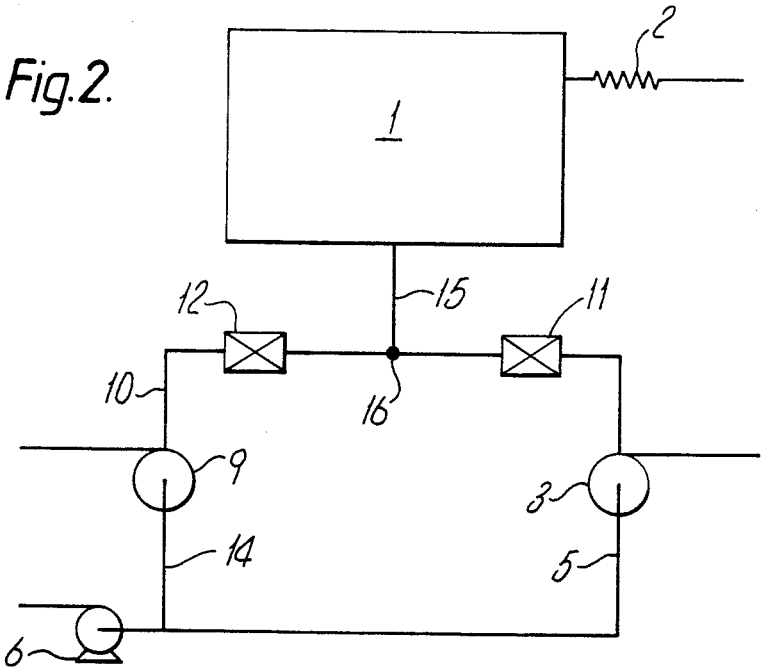
FIG. 2 is a diagram of a first embodiment of a ventilation system for a glove box and according to the invention.
Figure 3:
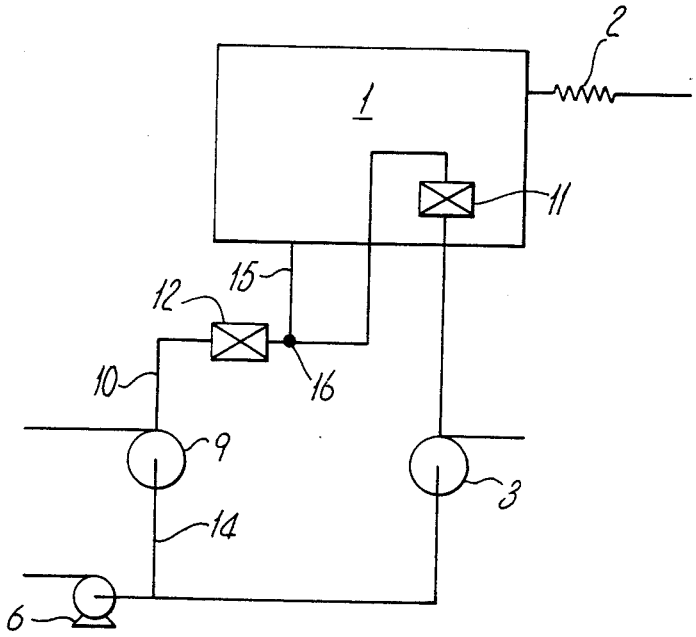
FIG. 3 is a diagram of a second embodiment according to the invention.

In FIGS. 1, 2 and 3, the same reference numerals are employed to indicate identical component parts.

In FIG. 1, a glove box 1 having a controlled inflow 2 is maintained at a required depression relative to atmosphere by a vortex amplifier 3. A vortex amplifier is a fluidic device comprising a vortex chamber having radial, axial and tangential flow ports. The radial port is the flow inlet and communicates with flow line 4 leading to the glove box. The axial port is the flow outlet and is connected through flow line 5 to a suction pump 6. The, or each, tangential port 7 is a control open to the atmosphere and can be provided with a filter 8. In practice the vortex amplifier can have a plurality of control ports.

A second vortex amplifier 9 is connected in parallel with the first vortex amplifier 3 between the glove box 1 and the suction pump 6. The radial port of this vortex amplifier communicates with the glove box along line 10 and respective filters 11 and 12 are provided in the lines 4 and 10. A filter 13 can be provided in the or each flow line to the control port or ports of the vortex amplifier 9.

The vortex amplifiers 3 and 9 are chosen such that under normal operating conditions the required depression within the box 1 is maintained by the vortex amplifier 3. The vortex amplifier 9 provides a reverse flow along line 10 into the box, this reverse flow being a small part of the control flow into the vortex amplifier. A greater part of the control flow into the vortex amplifier 9 is extracted by the pump 6 along line 14. In the event of a breach of containment of the box 1, the vortex amplifier 9 functions to provide an emergency extract capability.

The reverse flow into the box 1 from the vortex amplifier 9 maintains the filter 12 in a clean condition and prevents clogging of the filter, in particular, under dry or dusty conditions within the box. Such clogging or blocking of the filter would render the emergency extract capability inoperative.

When it is required to maintain an inert gas atmosphere within the box 1 the reverse purge flow, which is taken from the atmosphere, must be avoided. This can be achieved by admitting an inert gas supply to the control ports of the vortex amplifier 9. However, this would require a continuous supply of expensive inert gas, the major portion of which would be lost immediately to atmosphere along the line 14 leading to the suction pump 6. In addition means would be required for supplying such inert gas at atmospheric pressure for the correct operation of the vortex amplifier 9.

These drawbacks involving the use of inert gas are overcome by the ventilation system shown in FIG. 2. In FIG. 2, the filters 11 and 12 are arranged between the respective vortex amplifiers 3 and 9 and a common flow line 15 from the glove box 1. The system functions in a manner similar to that of FIG. 1 in that under normal operating conditions the required depression within the box is maintained by the vortex amplifier 3 and a reverse flow from the vortex amplifier 9 along the line 10 passes through the filter 12 to keep the filter in a clean condition. This reverse flow mixes with the flow from the box 1 at the junction 16 and is exhausted to atmosphere through the pump 6. The reverse flow does not enter the glove box 1 and consequently the flow at the control ports of the vortex amplifier 9 can be atmospheric air. In an emergency situation the flow from the box will be along the lines 15, 10 and 14 to the suction pump 6.

Filter 11 is in the normal extract line and will become contaminated with use. To facilitate filter changing, the filter 11 can be located within the glove box as shown in FIG. 3.

I claim:

1. A ventilation system for a containment comprising a single flow line from the containment, exhaust means, a first extract line including a first vortex amplifier and first filter, a second extract line including a second vortex amplifier and second filter, said first extract line and said second extract line being disposed in parallel with first ends of said lines being connected to said single flow line exterior to the containment and the other ends of said lines being connected to said exhaust means whereby when said second extract line is operated in the reverse mode the flow is through the second filter and directly into the first extract line without first passing through the containment.

2. A ventilation system according to claim 1 in which the filter in the first extract line is located within the containment.

* * * * *